US012766580B2

(12) United States Patent
Nogiwa et al.

(10) Patent No.: US 12,766,580 B2
(45) Date of Patent: Oct. 20, 2026

(54) FORMING DEVICE

(71) Applicant: SUMITOMO HEAVY INDUSTRIES, LTD., Tokyo (JP)

(72) Inventors: Kimihiro Nogiwa, Niihama (JP); Akihiro Ide, Niihama (JP); Masashi Kawakami, Niihama (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 234 days.

(21) Appl. No.: 18/667,979

(22) Filed: May 17, 2024

(65) Prior Publication Data

US 2024/0300000 A1 Sep. 12, 2024

Related U.S. Application Data

(63) Continuation of application No. PCT/JP2023/003845, filed on Feb. 6, 2023.

(30) Foreign Application Priority Data

Feb. 17, 2022 (JP) ..... 2022-023013

(51) Int. Cl.

| | |
|---|---|
| ***B21D 26/00*** | (2006.01) |
| ***B21D 22/02*** | (2006.01) |
| ***B21D 26/033*** | (2011.01) |
| ***B21D 37/16*** | (2006.01) |
| ***C21D 1/18*** | (2006.01) |

(Continued)

(52) U.S. Cl.

CPC ..... *B21D 26/033* (2013.01); *B21D 22/022* (2013.01); *B21D 37/16* (2013.01); *C21D 1/18* (2013.01); *C21D 1/673* (2013.01)

(58) Field of Classification Search

CPC .. B21D 26/033; B21D 22/022; B21B 22/022; C21D 1/18; C21D 1/673; B29C 43/48; B29C 2043/5816; B29C 43/58

See application file for complete search history.

(56) References Cited

U.S. PATENT DOCUMENTS 10,646,912 B2 * 5/2020 Ishizuka ..... B21D 26/041
2009/0242086 A1 * 10/2009 Thomas ..... C21D 8/04 148/654

(Continued)

FOREIGN PATENT DOCUMENTS

CN 102304612 A * 1/2012
CN 102888574 A 1/2013
CN 105 195 628 A 12/2015

(Continued)

OTHER PUBLICATIONS

European search report of EP Application No. 23756225.1 Mailed on Apr. 23, 2025.

(Continued)

*Primary Examiner* — Atul P. Khare
(74) *Attorney, Agent, or Firm* — WTA IP Law P.C.

(57) ABSTRACT

A forming device that forms a heated metal material includes a forming die that performs forming such that a quenching area of the metal material is quenched and a non-quenching area of the metal material is not quenched; and a temperature control unit that controls a temperature of the forming die such that warpage in the non-quenching area is reduced.

10 Claims, 10 Drawing Sheets

(51) Int. Cl.
*C21D 1/673* (2006.01)
*C22F 1/00* (2006.01)

(56) References Cited

U.S. PATENT DOCUMENTS

| | | | | |
|---|---|---|---|---|
| 2021/0008610 | A1* | 1/2021 | Irie | C21D 1/18 |
| 2021/0362208 | A1 | 11/2021 | Ishizuka et al. | |

FOREIGN PATENT DOCUMENTS

| | | | | | |
|---|---|---|---|---|---|
| CN | 112848179 | A | | 5/2021 | |
| CN | 114544698 | A | * | 5/2022 | G01N 25/20 |
| JP | H05-57365 | A | | 3/1993 | |
| JP | 2000-140954 | A | | 5/2000 | |
| JP | 2009-220141 | A | | 10/2009 | |
| JP | 2015-221445 | A | | 12/2015 | |
| JP | 2019-177390 | A | | 10/2019 | |
| WO | WO2 020/195579 | A1 | | 10/2020 | |

OTHER PUBLICATIONS

International Search Report of PCT/JP2023/003845 Mailed on Apr. 25, 2023.
Office Action of the corresponding CN Application No. 202380013918.7 Mailed on Jun. 13, 2026.

* cited by examiner

FORMING DEVICE

CROSS-REFERENCE TO RELATED APPLICATIONS

This is a bypass continuation of International PCT Application No. PCT/JP2023/003845, filed on Feb. 6, 2023, which claims priority to Japanese Patent Application No. 2022-023013, filed on Feb. 17, 2022, which are incorporated by reference herein in their entirety.

BACKGROUND

Technical Field

A certain embodiment of the present disclosure relates to a forming device.

Description of Related Art

In the related art, a forming device that forms a heated metal material has been known. For example, the related art discloses a forming device including a die including a pair of a lower die and an upper die, a gas supply unit that supplies a gas into a metal pipe material held between the dies, and a heating unit that heats the metal pipe material by electrical heating. Such a forming device includes a cooling unit that causes water to flow through a flow path formed in the die in order to cool the heated metal pipe during the forming. Therefore, the forming device can perform quenching forming by bringing the cooled die into contact with the metal pipe material.

SUMMARY

According to an aspect of the present disclosure, there is provided a forming device that forms a heated metal material, the forming device including a forming die that performs forming such that a quenching area of the metal material is quenched and a non-quenching area of the metal material is not quenched, and a temperature control unit that controls a temperature of the forming die such that warpage in the non-quenching area is reduced.

In the forming device, the forming die performs the forming such that the quenching area of the metal material is quenched and the non-quenching area of the metal material is not quenched. Here, the temperature control unit controls the temperature of the forming die such that the warpage in the non-quenching area is reduced. Therefore, when the temperature of the metal material after the forming in the non-quenching area is lowered, it is possible to reduce the warpage caused by a difference in a heat shrinkage amount at each position in the circumferential direction of the metal material.

DETAILED DESCRIPTION

Figure 1:
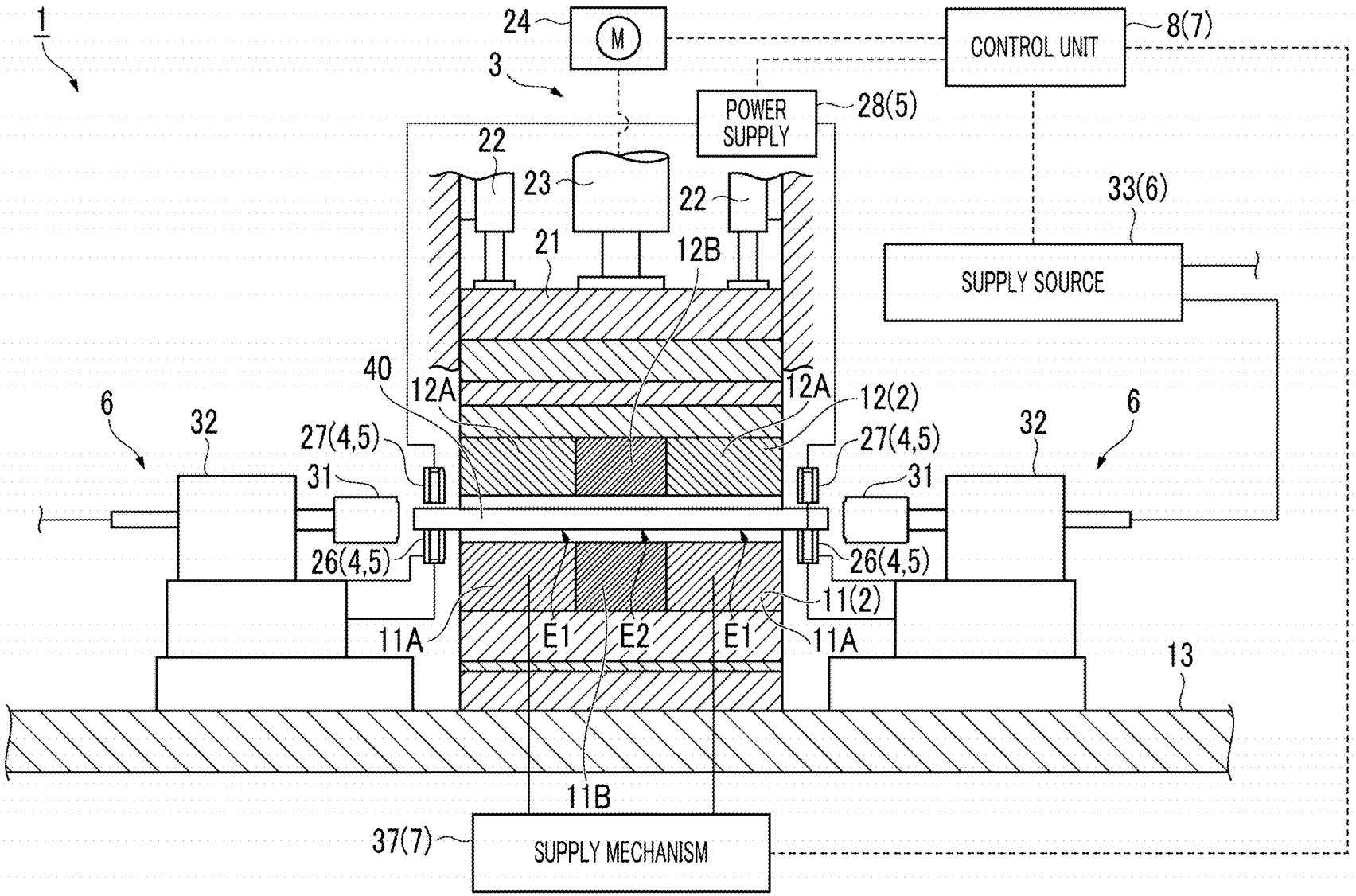
FIG. 1 is a schematic configuration view illustrating a forming device according to an embodiment of the present disclosure.

Here, the forming device may perform the forming such that a part of the metal material is quenched and the other parts are not quenched. In this case, a non-quenching area of the metal material has a high temperature when the die is opened. Therefore, when the non-quenching area is cooled to a room temperature, there is a possibility that the metal material may be warped due to thermal stress.

Therefore, it is desirable to provide a forming device that can suppress warpage of a metal material.

The temperature control unit may include a temperature measurement unit that measures a temperature of at least one of the metal material and the forming die, and control the temperature of the forming die such that a temperature difference in a circumferential direction of the metal material in the non-quenching area is reduced, based on a measurement result of the temperature measurement unit. Therefore, the temperature difference in the circumferential direction of the metal material can be identified by the temperature measurement unit. Further, the temperature control unit controls the temperature of the forming die such that the temperature difference in the circumferential direction of the metal material in the non-quenching area is reduced, based on the measurement result of the temperature measurement unit. Therefore, it is possible to more reliably suppress the occurrence of the difference in the heat shrinkage amount at each position in the circumferential direction of the metal material. Therefore, when the temperature of the metal material after the forming is lowered, it is possible to reduce the warpage caused by the difference in the heat shrinkage amount at each position in the circumferential direction.

The temperature control unit may control the temperature of the forming die such that a material temperature in the non-quenching area when the forming die is opened after the forming is equal to or higher than a martensite start temperature. In this case, even in a case where the temperature control unit performs the temperature control of the forming die, it is possible to suppress the quenching in the non-quenching area.

The forming die may include a first die and a second die, and the temperature control unit may control a temperature of each of the first die and the second die. Therefore, the temperature control unit can easily control the temperature of the forming die, and the temperature difference in the circumferential direction of the metal material can be easily suppressed.

The temperature control unit may control the temperature of the forming die based on feedback information on past actual results of the forming via the forming device. In this case, the temperature control unit can appropriately control the temperature of the forming die based on the actual results of the practical forming.

Hereinafter, a preferred embodiment of a forming device according to the present disclosure will be described with reference to the drawings. In the drawings, the same reference numerals will be given to the same portions or equivalent portions, and the redundant description thereof will be omitted.

FIG. 1 is a schematic configuration view of a forming device 1 according to the present embodiment. As illustrated in FIG. 1, the forming device 1 is a device that forms a metal pipe having a hollow shape by blow forming. In the present embodiment, the forming device 1 is installed on a horizontal plane. The forming device 1 includes a forming die 2, a drive mechanism 3, a holding unit 4, a heating unit 5, a fluid supply unit 6, a temperature control unit 7, and a control unit 8. In the present specification, a metal pipe material 40 (metal material) refers to a hollow article before the completion of forming via the forming device 1. The metal pipe material 40 is a steel-type pipe material that can be quenched. In addition, in a horizontal direction, a direction in which the metal pipe material 40 extends during the forming may be referred to as a "longitudinal direction", and a direction perpendicular to the longitudinal direction may be referred to as a "width direction".

The forming die 2 is a die that forms a metal pipe 140 (see FIGS. 5A and 5B) from the metal pipe material 40, and includes a lower die 11 and an upper die 12 that face each other in an up-down direction. The lower die 11 and the upper die 12 are configured by blocks made of steel. Each of the lower die 11 and the upper die 12 is provided with a recessed part in which the metal pipe material 40 is accommodated. In a state where the lower die 11 and the upper die 12 are in close contact with each other (die closed state), the respective recessed parts form a space having a target shape in which the metal pipe material is to be formed. Therefore, surfaces of the respective recessed parts are forming surfaces of the forming die 2. The lower die 11 is fixed to a base stage 13 via a die holder or the like. The upper die 12 is fixed to a slide of the drive mechanism 3 via a die holder or the like.

Here, in the present embodiment, the metal pipe 140 (metal pipe material 40) includes a quenching area E1 in which quenching is performed and a non-quenching area E2 in which quenching is not performed. Therefore, the forming die 2 performs the forming such that the quenching area E1 of the metal pipe material 40 is quenched and the non-quenching area E2 of the metal pipe material 40 is not quenched. The upper die 12 and the lower die 11 include quenching portions 12A and 11A that perform the quenching on the quenching area E1 and non-quenching portions 12B and 11B that prevent the quenching from being performed on the non-quenching area E2. In the present embodiment, the non-quenching area E2 is provided at a substantially central position of the metal pipe 140 (metal pipe material 40), and the quenching areas E1 are provided to interpose the non-quenching area E2 in the longitudinal direction. Therefore, the upper die 12 and the lower die 11 include the non-quenching portions 12B and 11B at the central position and the quenching portions 12A and 11A interposing the non-quenching area E2 in the longitudinal direction.

The drive mechanism 3 is a mechanism that moves at least one of the lower die 11 and the upper die 12. In FIG. 1, the drive mechanism 3 has a configuration of moving only the upper die 12. The drive mechanism 3 includes a slide 21 that moves the upper die 12 such that the lower die 11 and the upper die 12 are joined together, a pull-back cylinder 22 as an actuator that generates a force for pulling the slide 21 upward, a main cylinder 23 as a drive source that downward-pressurizes the slide 21, and a drive source 24 that applies a driving force to the main cylinder 23.

The holding unit 4 is a mechanism that holds the metal pipe material 40 disposed between the lower die 11 and the upper die 12. The holding unit 4 includes a lower electrode 26 and an upper electrode 27 that hold the metal pipe material 40 on one end side in the longitudinal direction of the forming die 2, and a lower electrode 26 and an upper electrode 27 that hold the metal pipe material 40 on the other end side in the longitudinal direction of the forming die 2. The lower electrodes 26 and the upper electrodes 27 on both sides in the longitudinal direction hold the metal pipe material 40 by interposing vicinities of end portions of the metal pipe material 40 from the up-down direction. Upper surfaces of the lower electrodes 26 and lower surfaces of the upper electrodes 27 are formed with groove portions having a shape corresponding to an outer peripheral surface of the metal pipe material 40. Drive mechanisms (not illustrated) are provided in the lower electrodes 26 and the upper electrodes 27 and are movable independently of each other in the up-down direction.

The heating unit 5 heats the metal pipe material 40. The heating unit 5 is a mechanism that heats the metal pipe material 40 by energizing the metal pipe material 40. The heating unit 5 heats the metal pipe material 40 in a state where the metal pipe material 40 is spaced apart from the lower die 11 and the upper die 12, between the lower die 11 and the upper die 12. The heating unit 5 includes the lower electrodes 26 and the upper electrodes 27 on both sides in the longitudinal direction, and a power supply 28 that causes a current to flow through the metal pipe material 40 via the electrodes 26 and 27. The heating unit may be disposed in a preceding process of the forming device 1 to perform heating externally.

The fluid supply unit 6 is a mechanism that supplies a high-pressure fluid into the metal pipe material 40 held between the lower die 11 and the upper die 12. The fluid supply unit 6 supplies the high-pressure fluid into the metal pipe material 40 that has been brought into a high-temperature state by being heated by the heating unit 5, to expand the metal pipe material 40. The fluid supply units 6 are provided on both end sides of the forming die 2 in the longitudinal direction. The fluid supply unit 6 includes a nozzle 31 that supplies the fluid from an opening portion of an end portion of the metal pipe material 40 to an inside of the metal pipe material 40, a drive mechanism 32 that moves the nozzle 31 forward and backward with respect to the opening portion of the metal pipe material 40, and a supply source 33 that supplies the high-pressure fluid into the metal pipe material 40 via the nozzle 31. The drive mechanism 32 brings the nozzle 31 into close contact with the end portion of the metal pipe material 40 in a state in which sealing performance is secured during the fluid supply and exhaust, and causes the nozzle 31 to be spaced apart from the end portion of the metal pipe material 40 in other cases. The fluid supply unit 6 may supply a gas such as high-pressure air and an inert gas, as the fluid. Additionally, the fluid supply unit 6 may include the heating unit 5 together with the holding unit 4 including a mechanism that moves the metal pipe material 40 in the up-down direction as the same device.

Figure 2A:
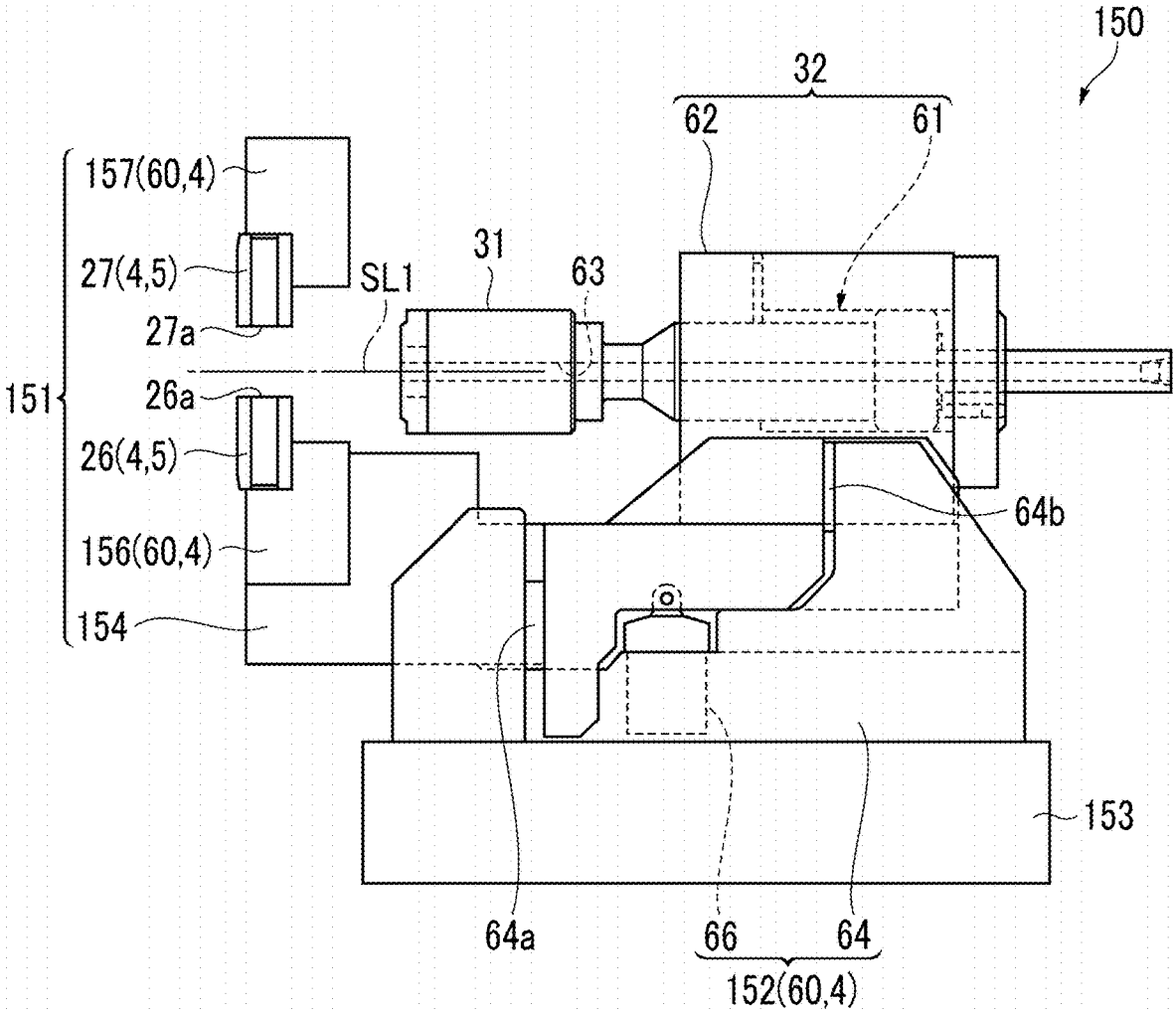
FIG. 2A is a schematic side view illustrating a heating and expanding unit.
Figure 2B:
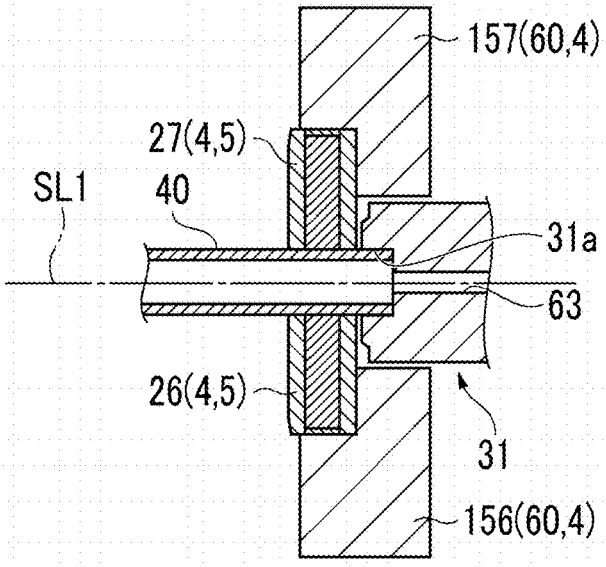
FIG. 2B is a sectional view illustrating a state where a nozzle has sealed a metal pipe material.

Components of the holding unit 4, the heating unit 5, and the fluid supply unit 6 may be configured as a unitized heating and expanding unit 150. FIG. 2A is a schematic side view illustrating the heating and expanding unit 150. FIG. 2B is a sectional view illustrating a state where the nozzle 31 has sealed the metal pipe material 40.

As illustrated in FIG. 2A, the heating and expanding unit 150 includes the lower electrode 26, the upper electrode 27, an electrode mounting unit 151 in which the electrodes 26 and 27 are mounted, the nozzle 31, the drive mechanism 32, an elevating unit 152, and a unit base 153. The electrode mounting unit 151 includes an elevating frame 154 and electrode frames 156 and 157. The electrode frames 156 and 157 function as a part of a drive mechanism 60 that supports and moves each of the electrodes 26 and 27. The drive mechanism 32 drives the nozzle 31 and moves up and down together with the electrode mounting unit 151. The drive mechanism 32 includes a piston 61 that holds the nozzle 31, and a cylinder 62 that drives the piston. The elevating unit 152 includes an elevating frame base 64 attached to an upper surface of the unit base 153, and an elevating actuator 66 that applies an elevating operation to the elevating frame 154 of the electrode mounting unit 151 by using the elevating frame base 64. The elevating frame base 64 includes guide portions 64*a* and 64*b* that guide the elevating operation of the elevating frame 154 with respect to the unit base 153. The elevating unit 152 functions as a part of the drive mechanism 60 of the holding unit 4. The heating and expanding unit 150 includes a plurality of the unit bases 153 of which the upper surfaces have different inclination angles, and is allowed to collectively change and adjust inclination angles of the lower electrode 26, the upper electrode 27, the nozzle 31, the electrode mounting unit 151, the drive mechanism 32, and the elevating unit 152 by replacing the unit bases 153.

The nozzle 31 is a cylindrical member into which the end portion of the metal pipe material 40 can be inserted. The nozzle 31 is supported by the drive mechanism 32 such that a center line of the nozzle 31 coincides with a reference line SL1. An inner diameter of a feed port 31*a* at an end portion of the nozzle 31 on the metal pipe material 40 side substantially coincides with an outer diameter of the metal pipe material 40 after expansion forming. In this state, the nozzle 31 supplies the high-pressure fluid from an internal flow path 63 to the metal pipe material 40. Examples of the high-pressure fluid include a gas.

Returning to FIG. 1, the temperature control unit 7 is a mechanism that controls a temperature of the forming die 2. The temperature control unit 7 controls the temperature of the forming die 2 such that the warpage in the non-quenching area E2 is reduced. The temperature control unit 7 can rapidly cool the metal pipe material 40 when the expanded metal pipe material 40 comes into contact with the forming surface of the forming die 2, by cooling the forming die 2 in the quenching portions 12A and 11A. In addition, the temperature control unit 7 can control the temperature of the metal pipe material 40 to a temperature at which the quenching does not occur when the expanded metal pipe material 40 comes into contact with the forming surface of the forming die 2, by performing the temperature control of the forming die 2 in the non-quenching portions 12B and 11B. The temperature control unit 7 includes flow paths formed inside the lower die 11 and the upper die 12, a supply mechanism 37 that supplies a temperature control medium and causes the temperature control medium to circulate through the flow paths, and a control unit 8 that controls the supply mechanism 37.

The control unit 8 is a device that controls the entire forming device 1. The control unit 8 controls the drive mechanism 3, the holding unit 4, the heating unit 5, the fluid supply unit 6, and the supply mechanism 37. The control unit 8 repeatedly performs the operation of forming the metal pipe material 40 using the forming die 2.

Specifically, the control unit 8 controls, for example, a transport timing from a transport device, such as a robot arm, to dispose the metal pipe material 40 between the lower die 11 and the upper die 12 in an open state. Alternatively, a worker may manually dispose the metal pipe material 40 between the lower die 11 and the upper die 12. Additionally, the control unit 8 controls an actuator of the holding unit 4 and the like such that the metal pipe material 40 is supported by the lower electrodes 26 on both sides in the longitudinal direction, and then the upper electrodes 27 are lowered to interpose the metal pipe material 40. In addition, the control unit 8 controls the heating unit 5 to electrically heat the metal pipe material 40. Therefore, an axial current flows through the metal pipe material 40, and an electric resistance of the metal pipe material 40 itself causes the metal pipe material 40 itself to generate heat due to Joule heat.

The control unit 8 controls the drive mechanism 3 to lower the upper die 12 and bring the upper die 12 close to the lower die 11, thereby closing the forming die 2. Meanwhile, the control unit 8 controls the fluid supply unit 6 to seal the opening portions of both ends of the metal pipe material 40 with the nozzle 31 and supply the fluid. Therefore, the metal pipe material 40 softened by the heating expands and comes into contact with the forming surface of the forming die 2. Then, the metal pipe material 40 is formed to follow a shape of the forming surface of the forming die 2. In addition, in a case where a metal pipe with a flange is formed, a part of the metal pipe material 40 is made to enter a gap between the lower die 11 and the upper die 12, and then die closing is further performed to crush the entering part to form a flange portion. When the quenching area E1 of the metal pipe material 40 comes into contact with the forming surface, the metal pipe material 40 is quenched by being rapidly cooled by using the forming die 2 cooled by the temperature control unit 7.

Figure 3:
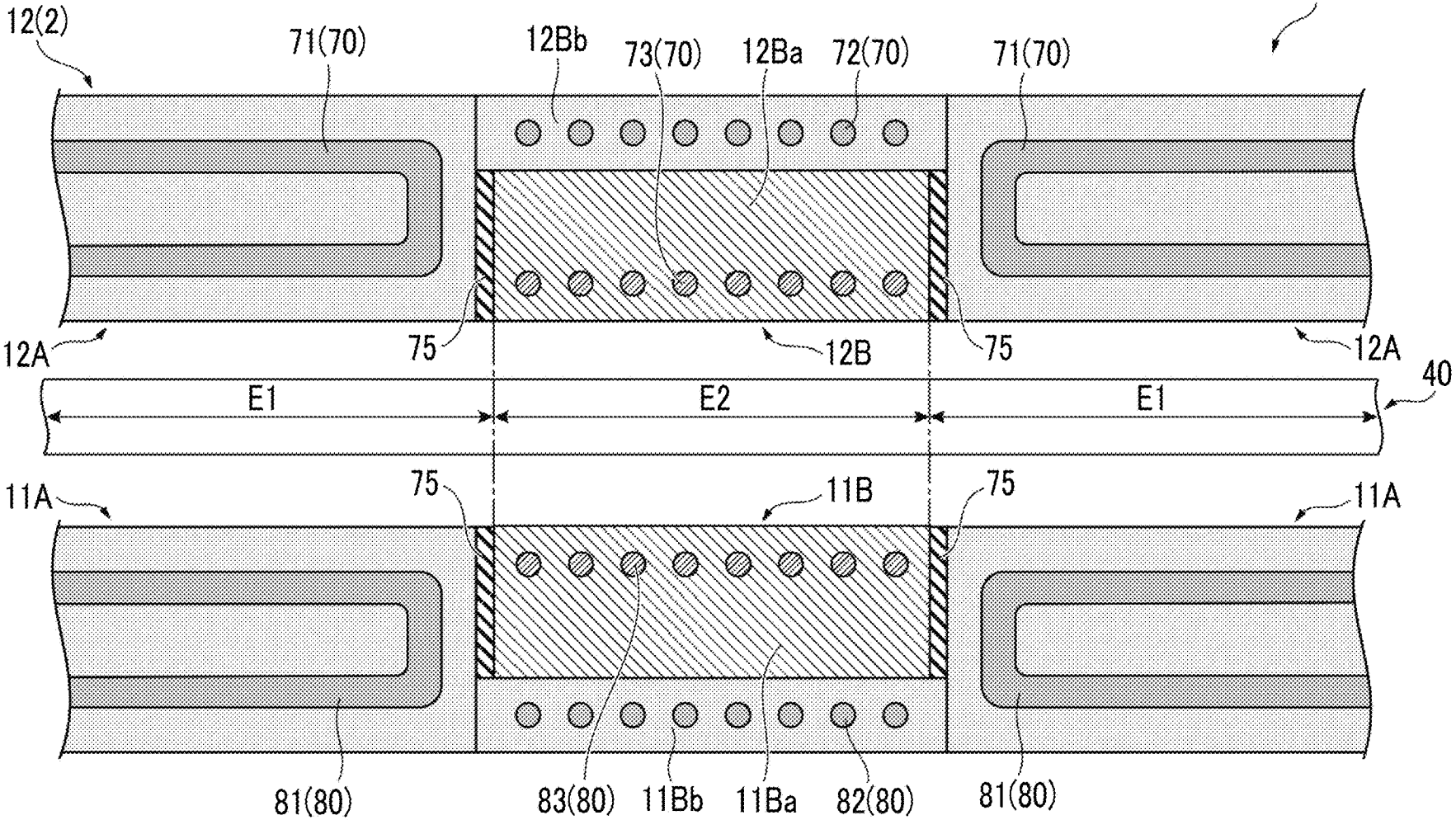
FIG. 3 is a schematic sectional view illustrating a temperature control mechanism of a forming die.

The temperature control unit 7 will be described in more detail with reference to FIG. 3. The temperature control unit 7 includes temperature control mechanisms 70 and 80 that control the temperature of the forming die 2. The temperature control mechanism 70 is provided inside the upper die 12, and controls the temperature of the forming surface of the die 12. The temperature control mechanism 80 is provided inside the lower die 11, and controls the temperature of the forming surface of the die 11. The temperature control mechanism 70 includes flow paths 71 provided in the quenching portions 12A on both sides of the die 12. The flow path 71 cools the forming surface of the quenching portion 12A by causing a cooling water from the supply mechanism 37 to flow therethrough. The temperature control mechanism 80 includes flow paths 81 provided in the quenching portions 11A on both sides of the die 11. The flow path 81 cools the forming surface of the quenching portion 11A by causing a cooling water from the supply mechanism 37 to flow therethrough.

Here, the non-quenching portions 12B and 11B include heating die blocks 12Ba and 11Ba on the forming surface side, and normal die blocks 12Bb and 11Bb on the opposite side. The normal die blocks 12Bb and 11Bb are blocks that connect the quenching portions 12A and 11A on both sides to each other. The temperature control mechanisms 70 and 80 include flow paths 72 and 82 provided in the normal die blocks 12Bb and 11Bb. The same cooling water as that in the flow paths 71 and 81 of the quenching portions 12A and 11A is supplied to the flow paths 72 and 82. The heating die blocks 12Ba and 11Ba are blocks having a higher temperature than the quenching portions 12A and 11A. A heat insulating member 75 (or a void) is provided between the quenching portions 12A and 11A and the heating die blocks 12Ba and 11Ba. The temperature control mechanisms 70 and 80 include flow paths 73 and 83 provided inside the heating die blocks 12Ba and 11Ba. The flow paths 73 and 83 cause the fluid having a higher temperature than the fluid in the flow paths 71 and 81 to flow therethrough, so that the forming surfaces of the non-quenching portions 12B and 11B have a higher temperature than the forming surfaces of the quenching portions 12A and 11A. The temperature control mechanisms 70 and 80 may include a heater and the like instead of the flow paths 73 and 83.

Figure 4:
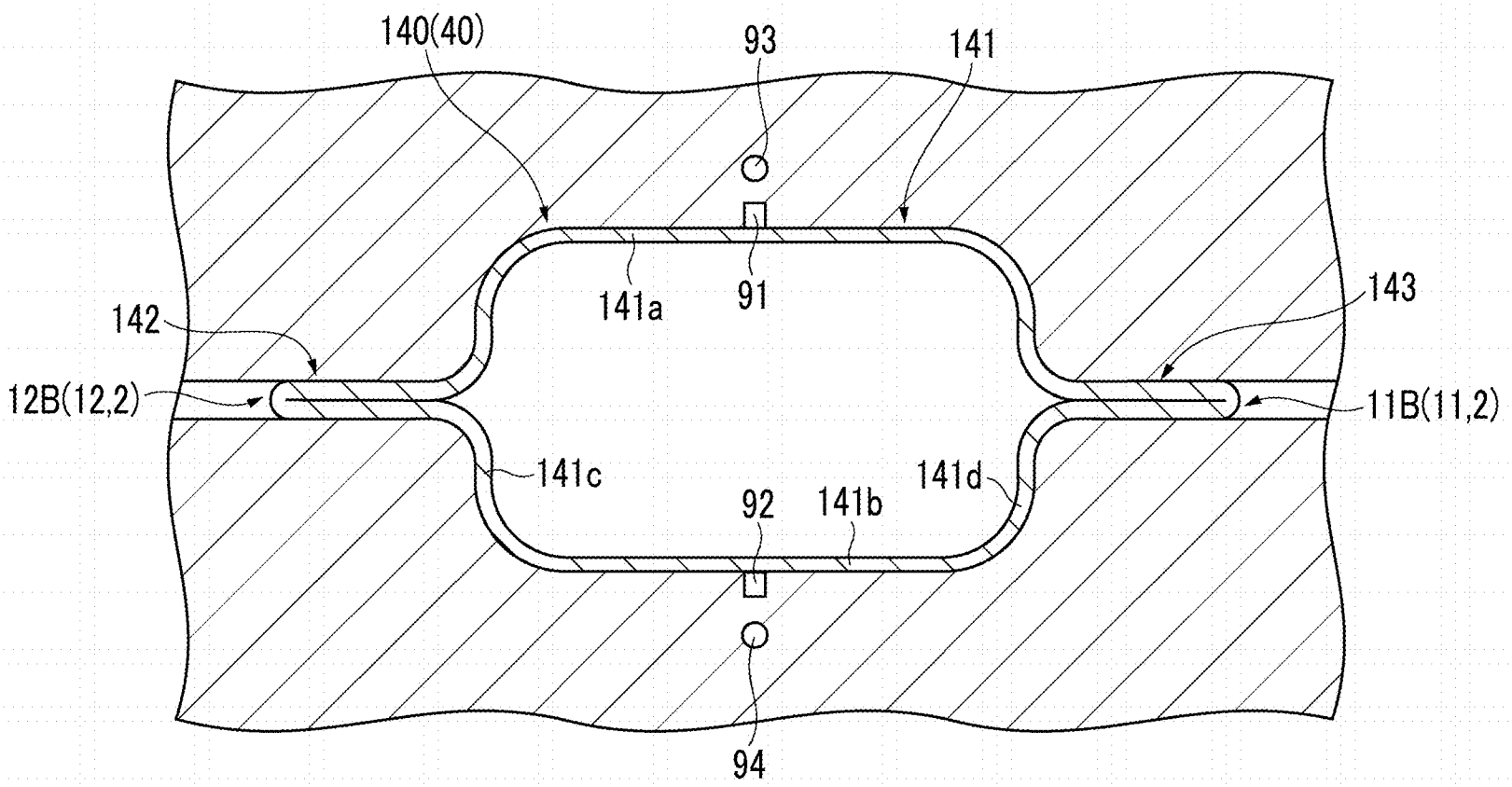
FIG. 4 is a sectional view of the forming die and a metal pipe in a non-quenching area.

As illustrated in FIG. 4, the metal pipe 140 after the forming includes a tubular pipe portion 141, and flange portions 142 and 143. The pipe portion 141 includes an upper wall portion 141*a* provided on the upper side, a lower wall portion 141*b* provided on the lower side, and side wall portions 141*c* and 141*d* provided with the flange portions 142 and 143. Since the upper wall portion 141*a* and the lower wall portion 141*b* are spaced apart from each other in the up-down direction, a temperature difference is likely to be formed. In contrast, temperature measurement units 91 and 92 that measure the temperature of the metal pipe 140 are provided in the non-quenching portions 12B and 11B of the dies 12 and 11. The temperature measurement unit 91 is provided to be exposed from the forming surface for forming the upper wall portion 141*a* and to be in contact with the upper wall portion 141*a*. Therefore, the temperature measurement unit 91 measures the temperature of the upper wall portion 141*a*. The temperature measurement unit 92 is provided to be exposed from the forming surface for forming the lower wall portion 141*b* and to be in contact with the lower wall portion 141*b*. Therefore, the temperature measurement unit 92 measures the temperature of the lower wall portion 141*b*. The temperature measurement units 91 and 92 are not particularly limited, and for example, an optical fiber radiation thermometer may be adopted. In addition, temperature measurement units 93 and 94 that measure the temperatures of the non-quenching portions 12B and 11B of the dies 12 and 11 are provided in the non-quenching portions 12B and 11B of the dies 12 and 11. The measurement results measured by the temperature measurement units 91, 92, 93, and 94 are transmitted to the control unit 8 (see FIG. 1).

Figure 5A:
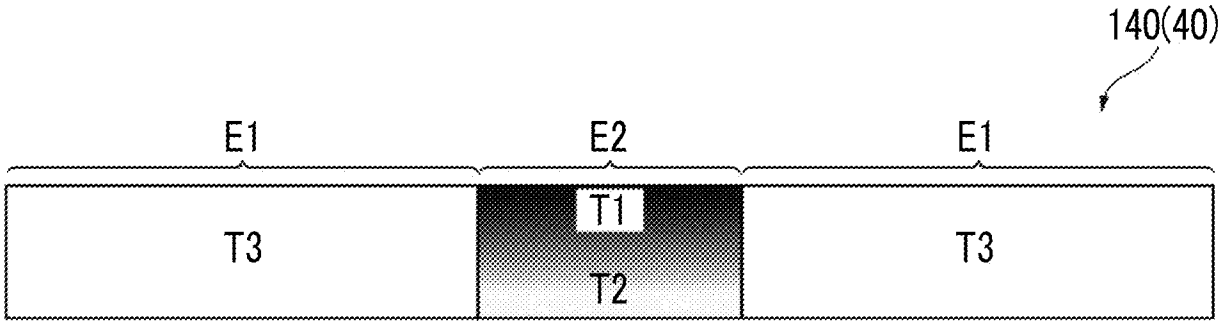
FIGS. 5A and 5B are schematic views illustrating a reason why warpage of the metal pipe occurs.

Hereinafter, the temperature control content via the temperature control unit 7 will be described. First, the warpage of the metal pipe 140 will be described with reference to FIGS. 5A and 5B. As illustrated in FIG. 5A, immediately after the forming die 2 is opened, the quenching area E1 is cooled to a low temperature T3. The temperature T3 need only be a temperature equal to or lower than a martensitic transformation end temperature Mf. Therefore, in order to perform the quenching on the quenching area E1, the temperature control unit 7 need only control the temperature such that the temperature T3≤Mf (200°° C. to 250° C.).

Figure 5B:
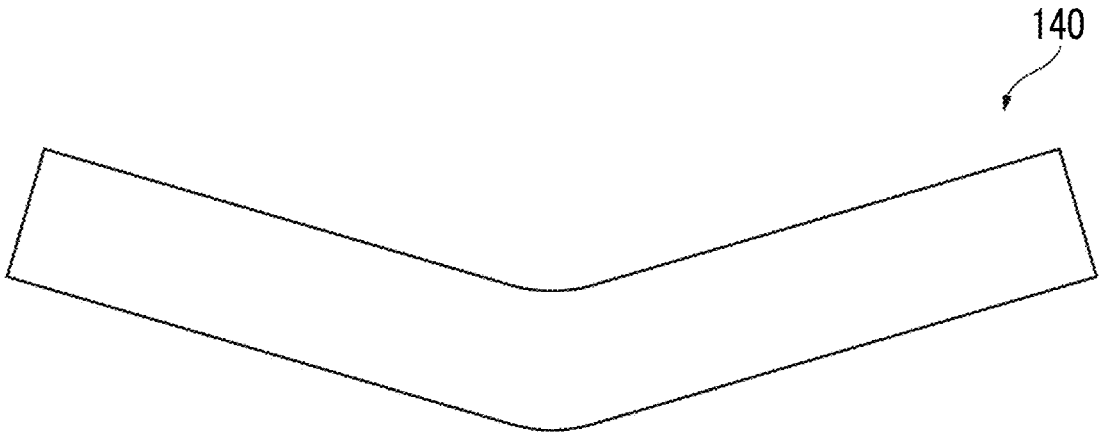
Figure 8A:
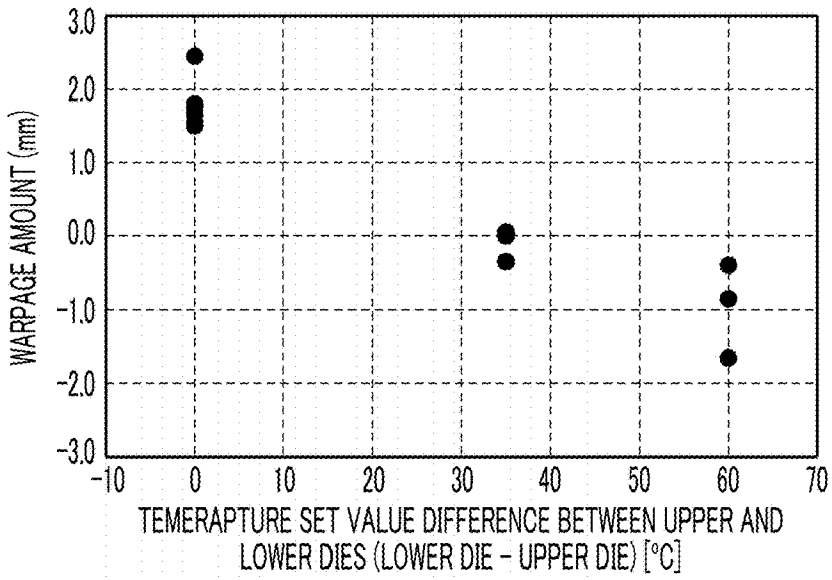
FIG. 8A is a graph illustrating a relationship between a set temperature difference between upper and lower dies, and a warpage amount.
Figure 8B:
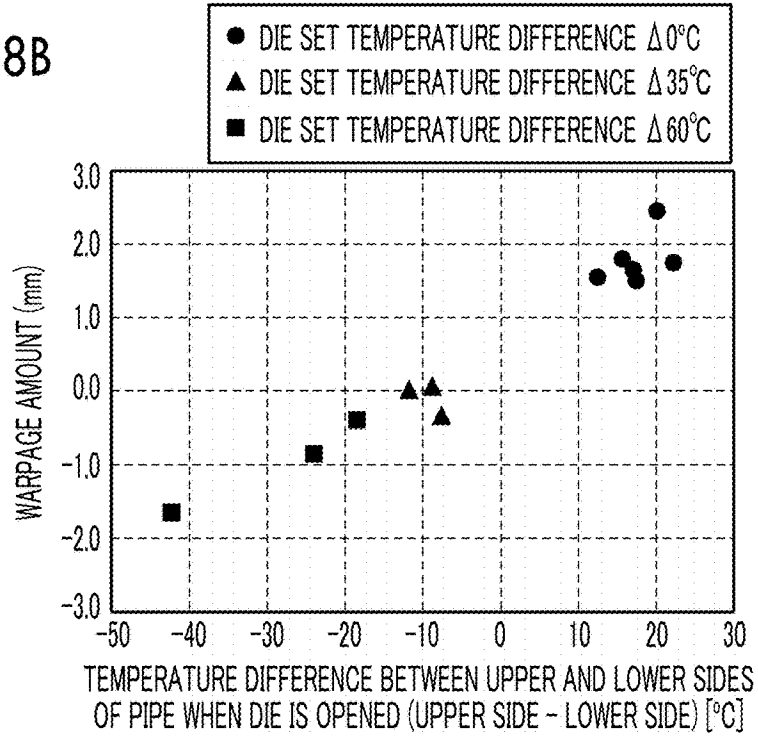
FIG. 8B is a graph illustrating a relationship between a temperature difference between upper and lower sides of the metal pipe, and a warpage amount.
Figure 8C:
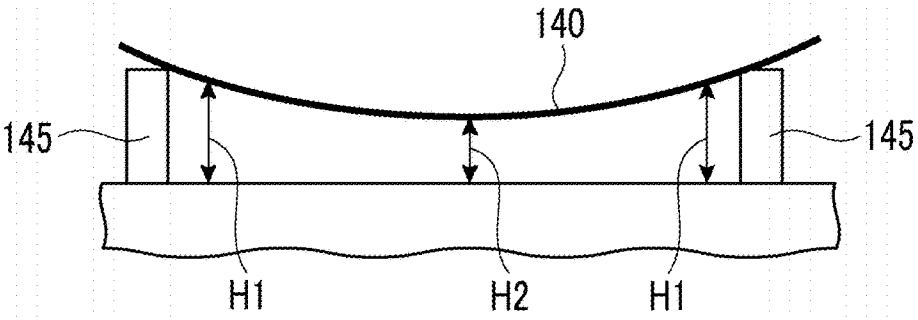
FIG. 8C is a view illustrating the warpage.

On the other hand, the non-quenching area E2 has the temperatures T1 and T2 higher than the temperature T3 such that quenching is not performed. The temperature T1 is an upper temperature of the metal pipe 140, and the temperature T2 is a lower temperature of the metal pipe 140. The temperature control unit 7 controls a material temperature in the non-quenching area E2 when the forming die 2 is opened after the forming to be equal to or higher than a martensite start temperature Ms. Specifically, the temperature control unit 7 need only control the temperature such that the temperature T1 and T2≥Ms (400°° C. to 430° C.) when the forming die 2 is opened. In this way, the temperatures T1 and T2 of the non-quenching area E2 are higher than a room temperature, and thus the non-quenching area E2 is cooled to the room temperature. Here, since the upper temperature T1 is lower than the lower temperature T2, the heat shrinkage amount until the metal pipe 140 is cooled to room temperature is larger on the upper side. In this way, in the non-quenching area E2, the temperature difference between the upper side and the lower side is large, and the difference in the shrinkage amount is generated between the upper side and the lower side, so that the metal pipe 140 is warped as illustrated in FIG. 5B. Here, the warpage of the metal pipe 140 will be described with reference to FIG. 8C. Both ends of the metal pipe 140 are fixed by a support portion 145. In this state, a height H1 of both end portions of the metal pipe 140 and a height H2 of the center are measured. In this case, a state where a difference is formed between the height H1 of both end portions and the height H2 of the central portion is a state where "warpage" has occurred. In addition, the difference between the height H1 of both end portions and the height H2 of the central portion is defined as a "warpage amount" as illustrated in FIGS. 8A and 8B.

Therefore, the temperature control unit 7 controls the temperature of the forming die 2 such that the temperature difference in the circumferential direction of the metal pipe material 40 in the non-quenching area E2 is reduced, based on the measurement results of the temperature measurement units 91, 92, 93, and 94. Specifically, the control unit 8 acquires the measurement results of the temperature measurement units 91, 92, 93, and 94, and controls the supply mechanism 37 such that the temperature difference in the circumferential direction in the non-quenching area E2 of the metal pipe material 40 is reduced (such that the warpage does not occur), and such that the upper temperature T1 and the lower temperature T2 have desired values.

The temperature control unit 7 may control the temperature of the forming die 2, based on feedback information on the past actual results of the forming via the forming device 1. For example, the forming device 1 acquires a relationship between the temperature difference in the forming die 2 (and the metal pipe 140) and the magnitude of the warpage after a predetermined number of the forming operations are performed. In this case, the control unit 8 analyzes how much warpage occurs depending on the degree of the temperature difference, to create training data. In this manner, the control unit 8 performs learning using the training data as the feedback information. In this manner, the control unit 8 estimates how much warpage occurs by referring to the measurement results of the temperature measurement units 91, 92, 93, and 94 in a case of the next forming, and controls the temperature of the forming die 2 in a case where the warpage is large.

Figure 6:
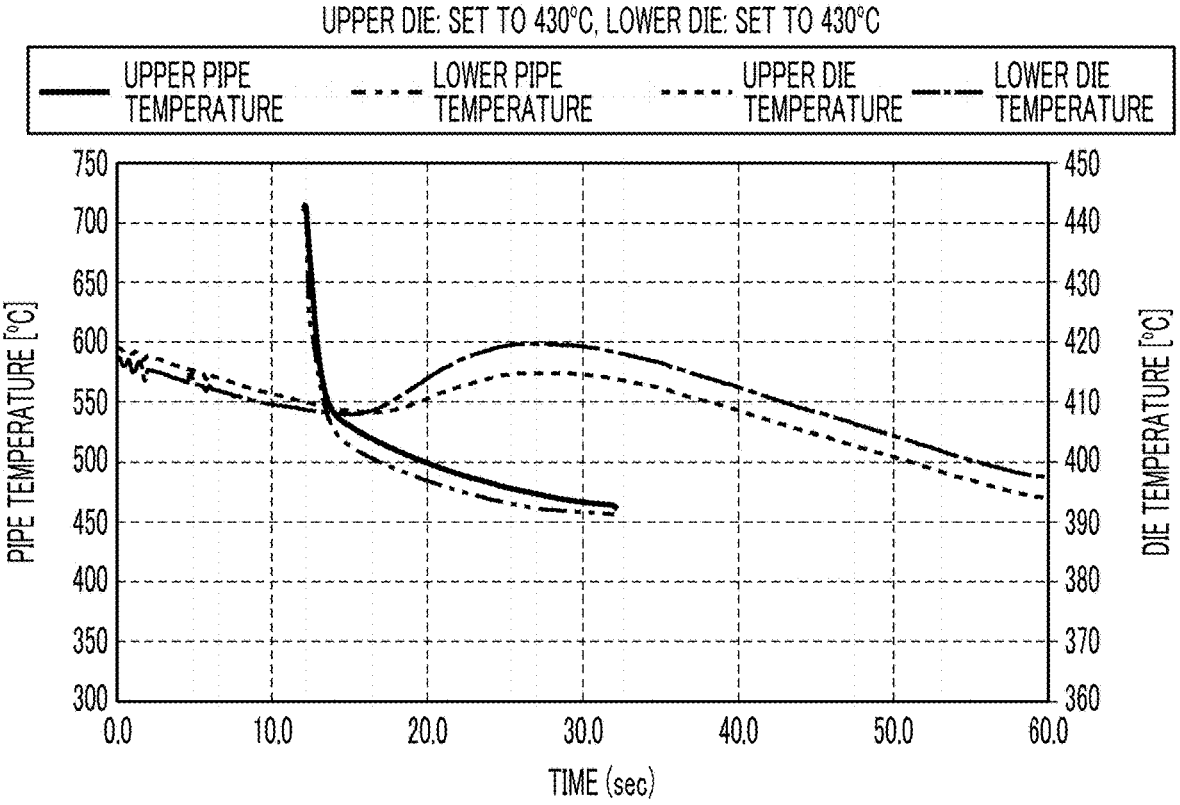
FIG. 6 is a graph illustrating temperature changes in a die and the metal pipe.
Figure 7A:
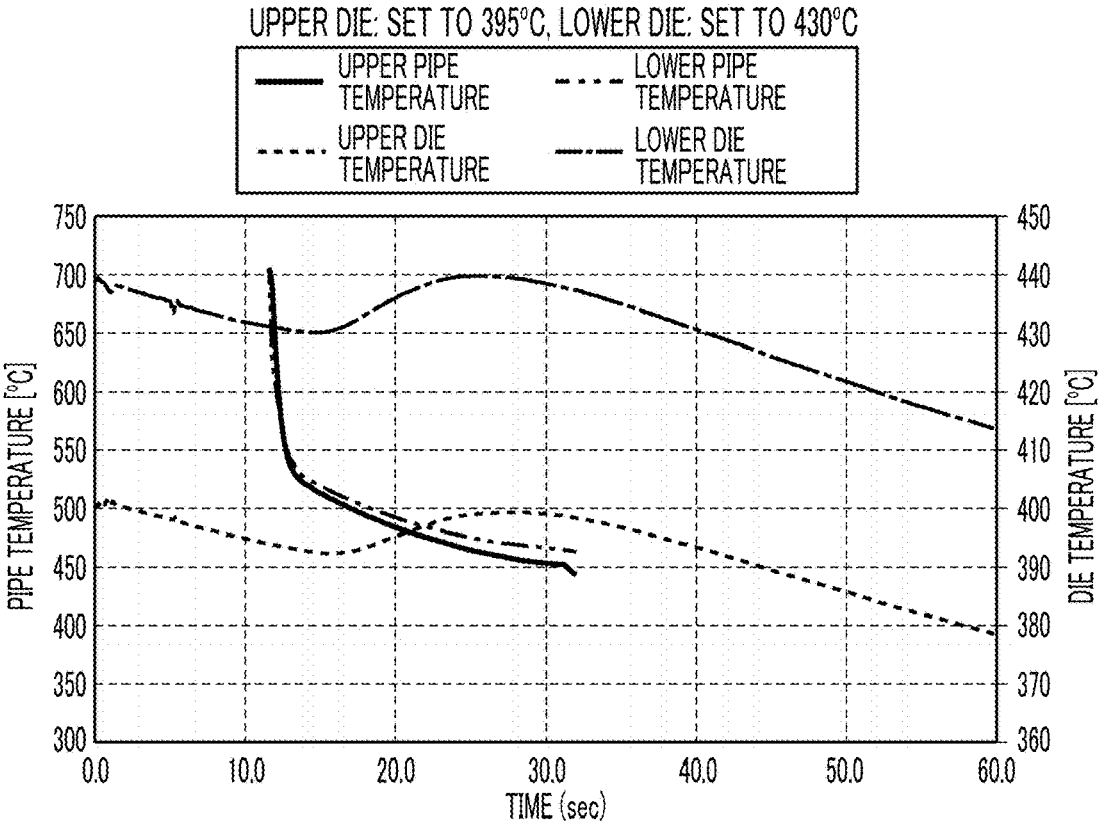
FIGS. 7A and 7B are graphs illustrating temperature changes in the die and the metal pipe.
Figure 7B:
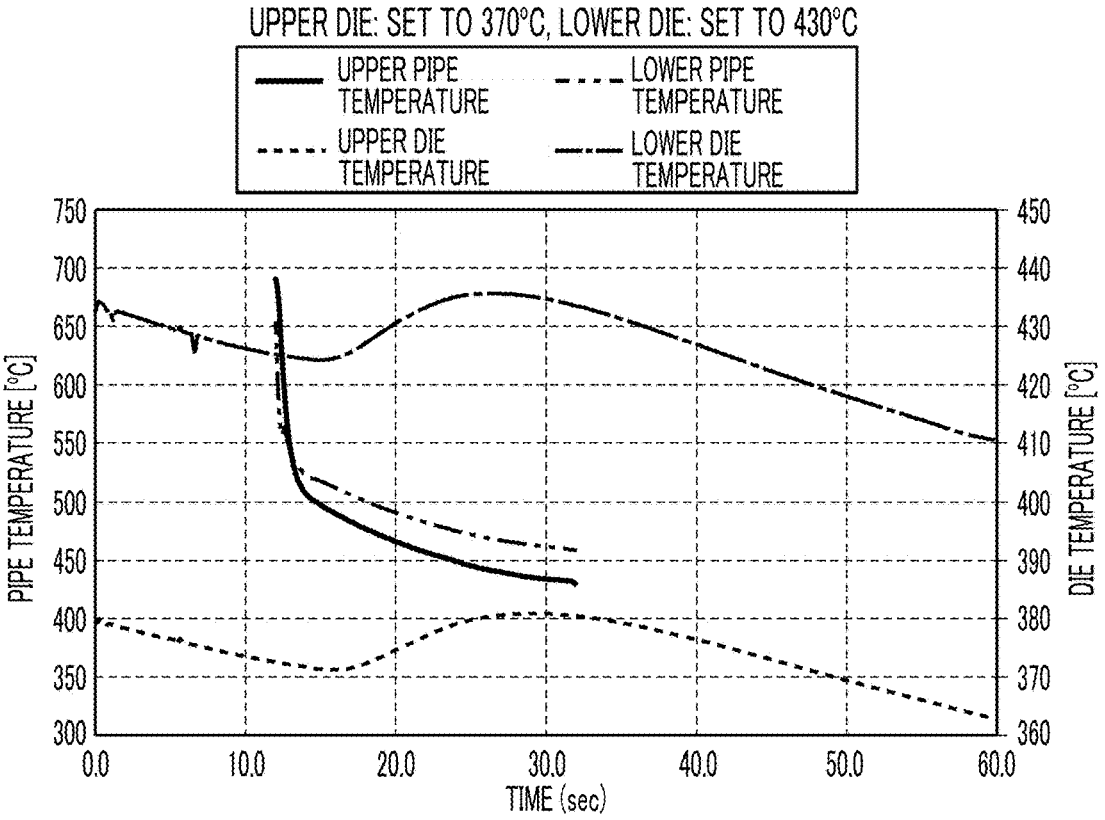

An example of specific temperature control by the temperature control unit 7 will be described with reference to FIGS. 6 to 8C. FIGS. 6 to 7B are graphs in which temporal changes in the temperature of the upper die 12 and the temperature of the lower die 11 are plotted, and temporal change in the temperatures of the upper side and the lower side of the metal pipe material 40 (metal pipe 140) corresponding thereto are plotted. FIG. 8A is a graph in which a relationship between the temperature difference between the upper die 12 and the lower die 11, and the warpage amount of the metal pipe 140 are plotted. FIG. 8B is a graph in which a relationship between the temperature difference between the upper side and the lower side of the metal pipe 140, and the warpage amount of the metal pipe 140 when the forming die 2 is opened is plotted.

The temperature difference between the upper and lower sides of the metal pipe 140 is reduced in a case where the set temperature of the upper die 12 is set to 395° C. (die set temperature difference 435° C.) as illustrated in FIG. 7A, rather than in a case where the set temperatures of the upper die 12 and the lower die 11 are set to 430° C. such that there is no temperature difference (die set temperature difference 40°° C.) as illustrated in FIG. 6. In addition, the temperature difference between the upper and lower sides of the metal pipe 140 is reduced in a case where the set temperature of the upper die 12 is set to 395° C. (die set temperature difference 435° C.) rather than in a case where the temperature of the upper die 12 is set to 370° C. (die set temperature difference 460° C.) as illustrated in FIG. 7B. Even with reference to FIGS. 8A and 8B, in a case where the die set temperature difference is 435° C. and the temperature difference between the upper and lower sides of the metal pipe 140 is reduced, the warpage amount is reduced. For example, in FIG. 8A, the warpage amount is the smallest in a case where the temperature difference between the upper die 12 and the lower die 11 is 35° C. In addition, in FIG. 8B, the temperature difference between the upper and lower sides of the pipe is the smallest by setting the die set temperature difference to 435° C., and as a result, it can be confirmed that the warpage amount is the smallest. The temperature control unit 7 can reduce the warpage of the metal pipe 140 by lowering the set temperature of the upper die 12 based on 430°° C. as the set temperature of the forming die 2.

Figure 9A:
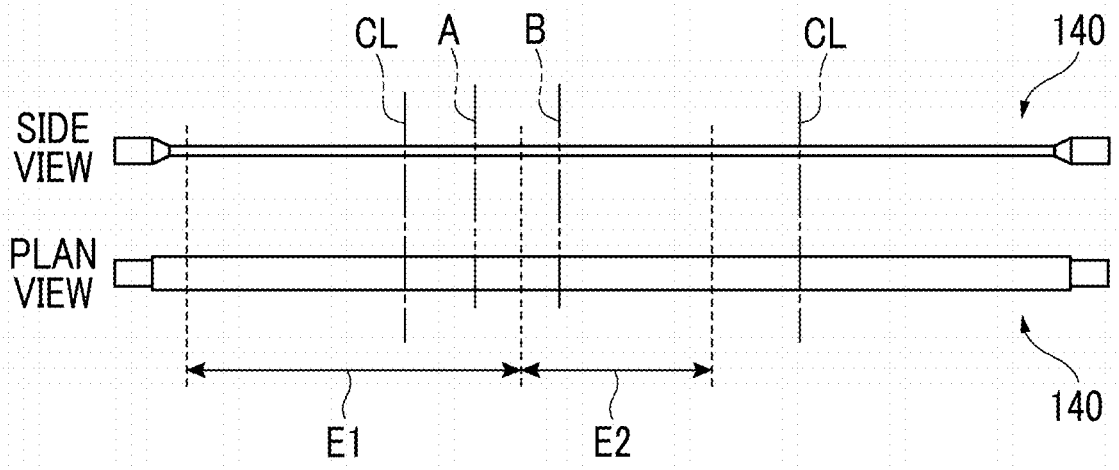
FIGS. 9A and 9B are views illustrating a method of measuring hardness.
Figure 9B:
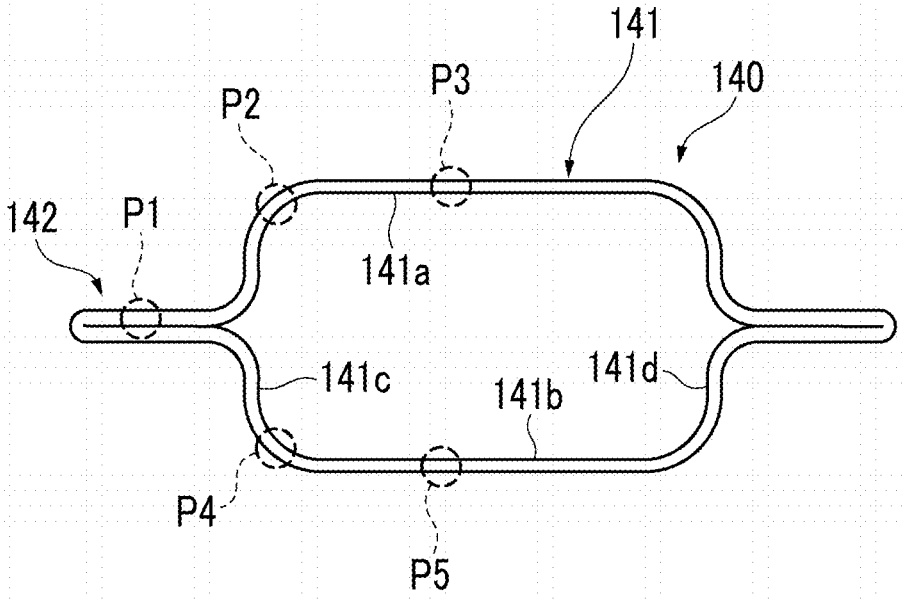
Figure 10A:
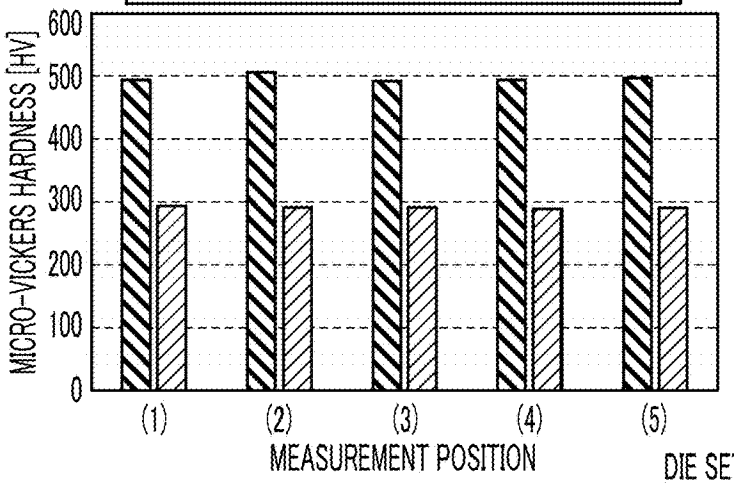
FIGS. 10A to 10C are graphs illustrating a measurement result of the hardness.
Figure 10B:
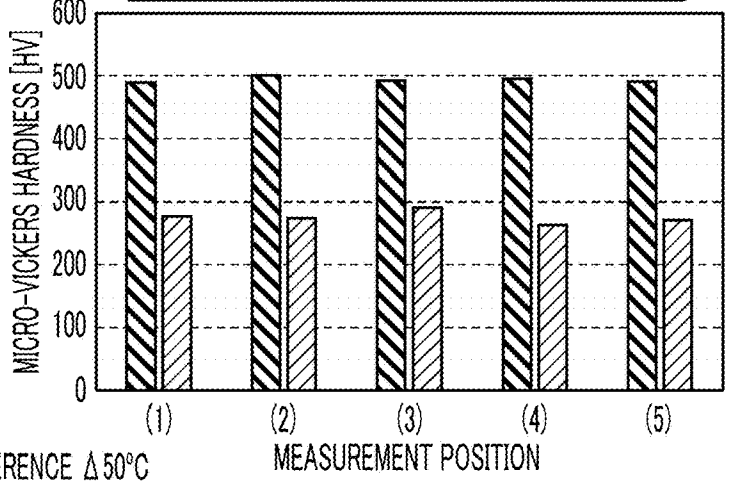
Figure 10C:
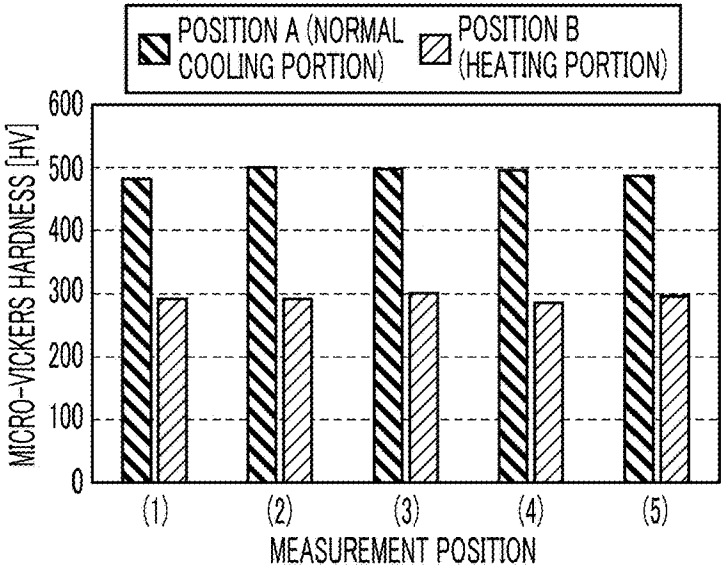

FIGS. 10A to 10C are results of evaluating a hardness distribution of the metal pipe 140 related to each temperature control illustrated in FIGS. 6 to 9B. In the evaluation, as illustrated in FIG. 9A, the metal pipe 140 was cut at a roughing cutting position CL and cut out, and the hardness distributions at sectional measurement positions A and B were measured. The sectional measurement position A is any position in the quenching area E1. The sectional measurement position B is any position in the non-quenching area E2. In addition, as illustrated in FIG. 9B, the micro-Vickers hardness at measurement positions P1 to P5 in each section was measured. As illustrated in FIGS. 10A to 10C, it is confirmed that, at any die set temperature, the quenching is performed at the sectional measurement position A of the quenching area E1, and the hardness can be secured at each of the positions P1 to P5. In addition, it is confirmed that, at the sectional measurement position B of the non-quenching area E2, the hardness at each of the positions P1 to P5 is low, and partial quenching suppression, which is the original purpose, can be achieved, and the hardness values are not affected.

Hereinafter, the actions and effects of the forming device 1 according to the present embodiment will be described.

In the forming device 1, the forming die 2 performs the forming such that the quenching area E1 of the metal material is quenched and the non-quenching area E2 of the metal material is not quenched. Here, the temperature control unit 7 controls the temperature of the forming die 2 such that the warpage in the non-quenching area E2 is reduced. Therefore, when the temperature of the metal material after the forming in the non-quenching area E2 is lowered, it is possible to reduce the warpage caused by the difference in the heat shrinkage amount at each position in the circumferential direction of the metal material.

In the forming device 1, the temperature control unit 7 includes the temperature measurement units 91, 92, 93, and 94 that measure the temperature of at least one of the metal material and the forming die 2, and controls the temperature of the forming die 2 such that the temperature difference in the circumferential direction of the metal material in the non-quenching area E2 is reduced, based on the measurement results of the temperature measurement units 91, 92, 93, and 94. Therefore, the temperature measurement units 91, 92, 93, and 94 can identify the temperature difference in the circumferential direction of the metal material. Further, the temperature control unit 7 controls the temperature of the forming die 2 such that the temperature difference in the circumferential direction of the metal material in the non-quenching area E2 is reduced, based on the measurement results of the temperature measurement units 91, 92, 93, and 94. Therefore, it is possible to more reliably suppress the occurrence of the difference in the heat shrinkage amount at each position in the circumferential direction of the metal material. Therefore, when the temperature of the metal material after the forming is lowered, it is possible to reduce the warpage caused by the difference in the heat shrinkage amount at each position in the circumferential direction.

The temperature control unit 7 may control the temperature of the forming die 2 such that a material temperature in the non-quenching area E2 when the forming die 2 is opened after the forming is equal to or higher than the martensite start temperature. In this case, even in a case where the temperature control unit 7 performs the temperature control of the forming die 2, it is possible to suppress the quenching in the non-quenching area E2.

The forming die 2 may include the upper die 12 (first die) and the lower die 11 (second die), and the temperature control unit 7 may control the temperature of each of the upper die 12 and the lower die 11. Therefore, the temperature control unit 7 can easily control the temperature of the forming die 2, and the temperature difference in the circumferential direction of the metal pipe material 40 can be easily suppressed.

The temperature control unit 7 may control the temperature of the forming die 2, based on feedback information on the past actual results of the forming via the forming device 1. In this case, the temperature control unit 7 can appropriately control the temperature of the forming die 2 based on the actual results of the practical forming.

The present disclosure is not limited to the above-described embodiment described above.

For example, a shape of the metal pipe after the forming is not particularly limited, and a metal pipe without a flange may be formed instead of the metal pipe with the flange.

The forming device need only be a forming device that heats a metal material to perform the quenching, and a forming device using a hot stamping method may be adopted. In this case, the metal material is a plate material. It should be noted that, in a case of the plate material, since the forming surface of the die comes into contact with both a front surface and a back surface during the forming, a temperature difference in a circumferential direction of the plate material is likely to be suppressed. On the other hand, in a case of the metal pipe, a portion that comes into contact with the upper die and a portion that comes into contact with the lower die are spaced apart from each other, so that the temperature difference is likely to occur. Therefore, in a case where the metal pipe is formed, the effects of the present disclosure are more remarkable.

Aspect 1

A forming device that forms a heated metal material, the forming device including: a forming die that performs forming such that a quenching area of the metal material is quenched and a non-quenching area of the metal material is not quenched; and a temperature control unit that controls a temperature of the forming die such that warpage in the non-quenching area is reduced.

Aspect 2

The forming device according to aspect 1, in which the temperature control unit includes a temperature measurement unit that measures a temperature of at least one of the metal material and the forming die, and controls the temperature of the forming die such that a temperature difference in a circumferential direction of the metal material in the non-quenching area is reduced, based on a measurement result of the temperature measurement unit.

Aspect 3

The forming device according to aspect 1 or 2, in which the temperature control unit controls the temperature of the forming die such that a material temperature in the non-quenching area when the forming die is opened after the forming is equal to or higher than a martensite start temperature.

Aspect 4

The forming device according to any one of aspects 1 to 3, in which the forming die includes a first die and a second die, and the temperature control unit controls a temperature of each of the first die and the second die.

Aspect 5

The forming device according to any one of aspects 1 to 4, in which the temperature control unit controls the temperature of the forming die based on feedback information on past actual results of the forming via the forming device.

It should be understood that the invention is not limited to the above-described embodiment, but may be modified into various forms on the basis of the spirit of the invention. Additionally, the modifications are included in the scope of the invention.

What is claimed is:

1. A forming device that forms a metal pipe from a heated metal pipe material, the forming device comprising:

a forming die comprising a first die and a second die; and a temperature controller configured to control a temperature of the forming die, wherein the temperature controller includes a plurality of temperature measurement units, the plurality of temperature measurement units being configured to measure temperatures of an upper wall portion of the metal pipe, a lower wall portion of the metal pipe, a non-quenching portion of the first die, and a non-quenching portion of the second die, respectively, and the temperature controller is configured to control a temperature of each of the first die and the second die, based on measurement results of the plurality of temperature measurement units, to reduce a temperature difference in a circumferential direction of the metal pipe in a non-quenching area thereof.

2. The forming device according to claim 1, wherein the temperature controller is configured to control the temperature of each of the first die and the second die to maintain a material temperature of the metal pipe in the non-quenching area thereof to be equal to or higher than a martensite start temperature during a step of opening the forming die is after the forming.

3. The forming device according to claim 1, wherein the temperature controller further includes a first flow path provided inside the first die and a second flow path provided inside the second die, and a temperature control medium flows through the first flow path and the second flow path.

4. The forming device according to claim 3, wherein the temperature controller further includes:

a supply mechanism configured to supply and cause the temperature control medium to circulate through the first flow path and the second flow path; and a controller configured to control the supply mechanism.

5. The forming device according to claim 3, wherein the non-quenching portion of the first die includes a first die block on a forming surface side of the first die and a second die block on a side opposite to the forming surface side of the first die, and the first flow path is provided inside the second die block.

6. The forming device according to claim 5, wherein a heat insulating member or a void is provided between an area of the first die that performs quenching of the metal pipe and the first die block.

7. The forming device according to claim 5, wherein the non-quenching portion of the second die includes a third die block on a forming surface side of the second die and a fourth die block on a side opposite to the forming surface side of the second die, and the second flow path is provided inside the fourth die block.

8. The forming device according to claim 7, wherein a heat insulating member or a void is provided between an area of the second die that performs quenching of the metal pipe and the third die block.

9. The forming device according to claim 1, wherein the temperature controller further includes a first heater provided inside the first die and a second heater provided inside the second die.

10. The forming device according to claim 1, wherein the temperature controller controls the temperature of the forming die based on feedback information on past actual results of forming a metal pipe via the forming device.

* * * * *